US010006462B2

(12) United States Patent
Becerra et al.

(10) Patent No.: US 10,006,462 B2
(45) Date of Patent: Jun. 26, 2018

(54) SYSTEMS AND METHOD FOR WIRELESSLY COMMUNICATING WITH ELECTRIC MOTORS

(71) Applicant: Regal Beloit America, Inc., Beloit, WI (US)

(72) Inventors: Roger Carlos Becerra, Fort Wayne, IN (US); Brian L. Beifus, Fort Wayne, IN (US)

(73) Assignee: Regal Beloit America, Inc., Beloit, WI (US)

( * ) Notice: Subject to any disclaimer, the term of this patent is extended or adjusted under 35 U.S.C. 154(b) by 331 days.

(21) Appl. No.: 14/029,997

(22) Filed: Sep. 18, 2013

(65) Prior Publication Data

US 2014/0079564 A1 Mar. 20, 2014

Related U.S. Application Data

(60) Provisional application No. 61/702,356, filed on Sep. 18, 2012.

(51) Int. Cl.
*F04D 15/00* (2006.01)
*F04D 13/06* (2006.01)
(Continued)

(52) U.S. Cl.
CPC ..... *F04D 15/0066* (2013.01); *F04D 13/0693* (2013.01); *F24F 11/74* (2018.01); *F24F 11/56* (2018.01)

(58) Field of Classification Search
None
See application file for complete search history.

(56) References Cited

U.S. PATENT DOCUMENTS 4,459,519 A 7/1984 Erdman
4,638,233 A * 1/1987 Erdman ..... H02P 6/08 318/254.1
(Continued)

FOREIGN PATENT DOCUMENTS

AU 2003200802 A1 9/2003
CN 101045235 A 10/2007
(Continued)

OTHER PUBLICATIONS

Ebm-papst Mulfingen GmbH & Co. KG, EC Communication: Hardware and software for EC bus systems, Jan. 1-20, 2010, Ebm-papst, web and hardcopy sales support materials, http://www.ebmpapst.us/media/content/greentech/ec_tech/EC_communication_EN.pdf.
(Continued)

*Primary Examiner* — Quan-Zhen Wang
*Assistant Examiner* — Chico A Foxx
(74) *Attorney, Agent, or Firm* — Armstrong Teasdale LLP

(57) ABSTRACT

An electric motor communication system for use with a fluid moving system is provided. The electric motor communication system includes an electric motor including a wireless communication device configured to transmit and receive wireless signals, and a processing device coupled to the wireless communication device and configured to control the electric motor based at least in part on wireless signals received at the wireless communication device. The electric motor communication system further includes at least one external device configured to communicate wirelessly with the electric motor.

20 Claims, 5 Drawing Sheets

(51) Int. Cl.
*F24F 11/74* (2018.01)
*F24F 11/56* (2018.01)

(56) References Cited

U.S. PATENT DOCUMENTS 5,002,226 A 3/1991 Nelson
5,023,527 A 6/1991 Erdman et al.
5,202,951 A 6/1993 Doyle
5,220,255 A 6/1993 Alford
5,448,141 A 9/1995 Kelley et al.
5,951,664 A * 9/1999 Lambrecht ..... G06F 13/124 375/E7.02
6,054,694 A 4/2000 Paustian
6,100,602 A 8/2000 Schlaudroff et al.
6,104,113 A 8/2000 Beifus
6,112,152 A * 8/2000 Tuttle ..... G07B 15/063 340/5.61
6,170,241 B1 * 1/2001 Shibilski ..... H02H 7/0833 318/434
6,215,261 B1 4/2001 Becerra
6,241,156 B1 6/2001 Kline et al.
6,439,195 B1 8/2002 Warner
6,456,023 B1 9/2002 Becerra et al.
6,692,349 B1 2/2004 Brinkerhoff et al.
6,983,889 B2 1/2006 Alles
6,991,175 B1 * 1/2006 Huang ..... B29C 45/14639 235/492
6,997,390 B2 2/2006 Alles
7,020,689 B2 3/2006 Simyon et al.
7,089,066 B2 8/2006 Hesse et al.
7,016,019 B2 9/2006 Van Den Biggelaar et al.
7,110,829 B2 9/2006 Cunningham et al.
7,211,000 B2 * 5/2007 Jutzi ..... A63F 13/12 273/317
7,389,806 B2 6/2008 Kates
7,460,050 B2 12/2008 Alvardo et al.
7,496,627 B2 2/2009 Moorer et al.
7,787,907 B2 8/2010 Zeinstra et al.
7,808,368 B2 10/2010 Ebrom et al.
7,831,321 B2 11/2010 Ebrom et al.
7,986,938 B1 7/2011 Meenan et al.
7,990,985 B2 8/2011 Chen
7,994,471 B2 8/2011 Heslin et al.
8,001,219 B2 8/2011 Moorer et al.
8,014,412 B2 9/2011 Herbold
8,014,789 B2 9/2011 Breed
8,015,113 B2 9/2011 Barton et al.
8,015,123 B2 9/2011 Barton et al.
8,019,354 B2 9/2011 Rae et al.
8,019,501 B2 9/2011 Breed
8,504,646 B2 * 8/2013 Jeung ..... H02P 31/00 340/438
2002/0084173 A1 * 7/2002 Paquette ..... B65G 43/10 198/781.06
2002/0117986 A1 8/2002 Becerra et al.
2003/0210132 A1 * 11/2003 Tang ..... G05B 15/02 340/5.64
2004/0067731 A1 4/2004 Brinkerhoff et al.
2004/0160309 A1 * 8/2004 Stilp ..... G06K 7/0008 340/10.2
2005/0192724 A1 9/2005 Hendry
2005/0192727 A1 9/2005 Shostak et al.
2006/0161270 A1 7/2006 Luskin et al.
2006/0185799 A1 8/2006 Kates
2006/0212197 A1 * 9/2006 Butler ..... B60R 11/0235 701/36
2006/0215650 A1 9/2006 Wollmershauser et al.
2006/0247842 A1 11/2006 Diem
2006/0251115 A1 11/2006 Haque et al.
2006/0271321 A1 11/2006 Rutkowski et al.
2006/0286918 A1 * 12/2006 Vargas ..... B60H 1/00871 454/155
2007/0061067 A1 3/2007 Zeinstra et al.
2007/0087236 A1 * 4/2007 Komachiya ..... H01M 8/04007 429/412
2007/0178823 A1 * 8/2007 Aronstam ..... F24F 3/00 454/256
2007/0195400 A2 8/2007 Moskowitz
2007/0199989 A1 * 8/2007 Piety ..... G06K 19/07749 235/438
2007/0205962 A1 9/2007 Thompson
2007/0220142 A1 9/2007 Moorer et al.
2007/0229018 A1 * 10/2007 Mitchell ..... G01R 31/343 318/650
2007/0278320 A1 12/2007 Lunacek et al.
2008/0036590 A1 * 2/2008 Gonzales ..... G01K 1/024 340/539.27
2008/0043316 A2 2/2008 Whitaker et al.
2008/0077882 A1 * 3/2008 Kramer ..... B60K 35/00 715/810
2008/0119126 A1 * 5/2008 Shizuo ..... F04D 27/004 454/75
2008/0122585 A1 5/2008 Castaldo et al.
2008/0125912 A1 5/2008 Heilman et al.
2008/0157936 A1 7/2008 Ebrom et al.
2008/0186562 A2 8/2008 Moskowitz et al.
2008/0236763 A1 10/2008 Kates
2008/0287121 A1 11/2008 Ebrom et al.
2009/0013703 A1 * 1/2009 Werner ..... F24F 5/0046 62/180
2009/0055760 A1 2/2009 Whatcott et al.
2009/0060514 A1 3/2009 DiChiro et al.
2009/0096656 A1 4/2009 Smith
2009/0100132 A1 4/2009 Ebrom et al.
2009/0100153 A1 4/2009 Ebrom et al.
2009/0128067 A1 5/2009 Mullin
2009/0128068 A1 5/2009 Mullin
2009/0136360 A1 5/2009 Jeung
2009/0150356 A1 6/2009 Walker
2009/0209128 A1 8/2009 Mullin
2009/0271150 A1 * 10/2009 Stluka ..... G05B 23/0232 702/182
2009/0308543 A1 12/2009 Kates
2010/0033119 A1 2/2010 Becerra et al.
2010/0049528 A1 2/2010 Zeinstra et al.
2010/0054275 A1 3/2010 Noonan et al.
2010/0070100 A1 3/2010 Finlinson et al.
2010/0106304 A1 4/2010 Wawer et al.
2010/0243928 A1 9/2010 Flick et al.
2010/0277284 A1 * 11/2010 Brown ..... G06K 7/0008 340/10.3
2010/0294750 A1 * 11/2010 Hogenmueller ..... B60R 16/023 219/202
2010/0307733 A1 12/2010 Karamanos et al.
2011/0029136 A1 2/2011 Altonen et al.
2011/0029139 A1 2/2011 Altonen et al.
2011/0031806 A1 2/2011 Altonen et al.
2011/0035061 A1 2/2011 Altonen et al.
2011/0057038 A1 * 3/2011 Koo ..... G06K 7/10316 235/451
2011/0090334 A1 4/2011 Hicks, III et al.
2011/0155354 A1 6/2011 Karamanos et al.
2011/0178773 A1 7/2011 Shahi et al.
2011/0181216 A1 7/2011 Bass et al.
2011/0208170 A1 * 8/2011 Hafner ..... A61B 17/00 606/1
2011/0218690 A1 9/2011 O'Callaghan et al.
2011/0218691 A1 9/2011 O'Callaghan et al.
2011/0220630 A1 * 9/2011 Speilman ..... B23K 9/1336 219/137 R
2012/0151624 A1 * 6/2012 Gehin ..... A01H 5/10 800/265
2012/0151627 A1 * 6/2012 Maliga ..... C12N 15/8214 800/278
2012/0151629 A1 * 6/2012 McCaig ..... C12N 15/8285 800/279
2012/0176237 A1 * 7/2012 Tabe ..... A61B 5/6804 340/539.12
2013/0304142 A1 * 11/2013 Curtin ..... A61N 1/3975 607/5

(56) References Cited

U.S. PATENT DOCUMENTS

| | | | | |
|---|---|---|---|---|
| 2013/0304532 | A1* | 11/2013 | Cormier | F24F 11/0086 705/7.15 |
| 2014/0042876 | A1* | 2/2014 | Brockerhoff | H02K 11/25 310/68 B |
| 2015/0357887 | A1* | 12/2015 | Yamazaki | H02K 11/0078 318/490 |

FOREIGN PATENT DOCUMENTS

| | | | |
|---|---|---|---|
| CN | 201689521 | U | 12/2010 |
| DE | 3420560 | A1 | 12/1984 |
| EP | 440534 | A1 | 8/1991 |
| EP | 572149 | A1 | 12/1993 |
| EP | 881738 | A2 | 12/1998 |
| EP | 1727273 | A1 | 11/2006 |
| EP | 1758008 | A2 | 2/2007 |
| EP | 2034464 | A2 | 3/2009 |
| JP | 10132321 | A | 5/1998 |
| KR | 100864768 | B1 | 10/2008 |
| KR | 2009033534 | A | 4/2009 |
| KR | 2009051772 | A | 5/2009 |
| KR | 2009060431 | A1 | 6/2009 |
| KR | 2010010855 | A | 2/2010 |
| KR | 2010049904 | A | 5/2010 |
| WO | 2006060754 | A2 | 6/2006 |
| WO | 2008086109 | A2 | 7/2008 |
| WO | 2007109556 | A3 | 10/2008 |
| WO | 2008134657 | A2 | 11/2008 |
| WO | 2011017668 | A2 | 2/2011 |

OTHER PUBLICATIONS

Ziehl Abegg Australia Pty Ltd, Ziehl-Abegg Products, Mar. 1-7, 2010, Ziehl Abegg, web and hardcopy sales literature, http://www.ziehl-abegg.com/au/download-2337-ZIEHL-ABEGG-Products---ZAP-Edition-5.html.

Ziehl Abegg SE, FE2owlet-ECblue: Catalogue North America Edition 2013, 1-124, Jan. 2013, Ziehl Abegg, web and hardcopy, http://www.ziehl-abegg.com/us/download-3127.html.

Ziehl Abegg AG, AM-MODBUS/AM MODBUS-W: Operating Instructions, Mar. 1-14, 2010, Ziehl Abegg, web and hardcopy technical documentation, www.ziehl-begg.com/ww/download-2312.html.

Ziehl-Abegg AG, Press Release: ECblue: simple-efficient-reliable, Feb. 1, 2009, Ziehl Abegg AG, web press release, http://www.ziehl-abegg.com/us/press-release-154.html.

* cited by examiner

SYSTEMS AND METHOD FOR WIRELESSLY COMMUNICATING WITH ELECTRIC MOTORS

CROSS REFERENCE TO RELATED APPLICATIONS

This application is a non-provisional application and claims priority to U.S. Provisional Patent Application Ser. No. 61/702,356 filed Sep. 18, 2012 for "SYSTEMS AND METHOD FOR WIRELESSLY COMMUNICATING WITH ELECTRIC MOTORS", which is hereby incorporated by reference in its entirety.

BACKGROUND OF THE INVENTION

The field of the invention relates generally to electric motors, and more specifically, to wireless communications between electric motors and other devices.

Electronically commutated motors (ECMs) are used in a wide variety of applications because they are more efficient than known standard induction motors. ECMs include the efficiency and speed control advantages of a DC motor and minimize the disadvantages of DC motors, e.g., carbon brush wear, short life span, and noise. In Heating, Ventilation and Air Conditioning (HVAC) systems, as well as known commercial air distributions systems, ECMs automatically adjust blower speed to meet a wide range of airflow requirements. Known ECMs use microprocessor technology to control fan speed, torque, air flow, and energy consumption. In at least some known systems utilizing ECMs, power control systems are utilized to control the operation of the ECMs.

At least some known ECMs are coupled to a power control system by one or more physical connections (e.g., using wires, cables, etc.). ECMs may also be physically connected to other external devices. These physical connections occupy space, and generally require a user to manually connect wires, cables, etc. to a plurality of devices. Further, when physical connections between devices fail, a user typically must manually reconnect the devices, which may require replacing one or more wires, cables, etc. Accordingly, operating and maintaining ECM systems including several physical connections between an ECM and external devices may be relatively costly.

BRIEF DESCRIPTION OF THE INVENTION

In one aspect, an electric motor communication system for use with a fluid moving system is provided. The electric motor communication system includes an electric motor including a wireless communication device configured to transmit and receive wireless signals, and a processing device coupled to the wireless communication device and configured to control the electric motor based at least in part on wireless signals received at the wireless communication device. The electric motor communication system further includes at least one external device configured to communicate wirelessly with the electric motor.

In another aspect, an electric motor for use in a fluid-moving system is provided. The electric motor includes a wireless communication device configured to transmit and receive wireless signals to and from at least one external device, and a processing device coupled to the wireless communication device and configured to control the electric motor based at least in part on wireless signals received at the wireless communication device.

In yet another aspect, a method of operating an electric motor in a fluid-moving system is provided. The method includes communicatively coupling the electric motor to at least one external device, the electric motor including a wireless communication device and a processing device coupled to the wireless communication device, receiving, at the wireless communication device, wireless signals from the at least one external device, and controlling, using the processing device, the electric motor based at least in part on the received wireless signals.

DETAILED DESCRIPTION OF THE INVENTION

The methods and systems described herein facilitate efficient and economical manufacturing and operation of electric motor systems. As described herein, an electric motor communication system includes an electric motor including a wireless communication device and a processing device. Using the wireless communication device, the electric motor interfaces with a plurality of external devices without requiring physical connections between the external devices and the electric motor.

Technical effects of the methods and systems described herein include at least one of: (a) communicatively coupling an electric motor to at least one external device; (b) receiving wireless signals from the at least one external device; and (c) controlling the electric motor based at least in part on the received wireless signals.

Figure 1:
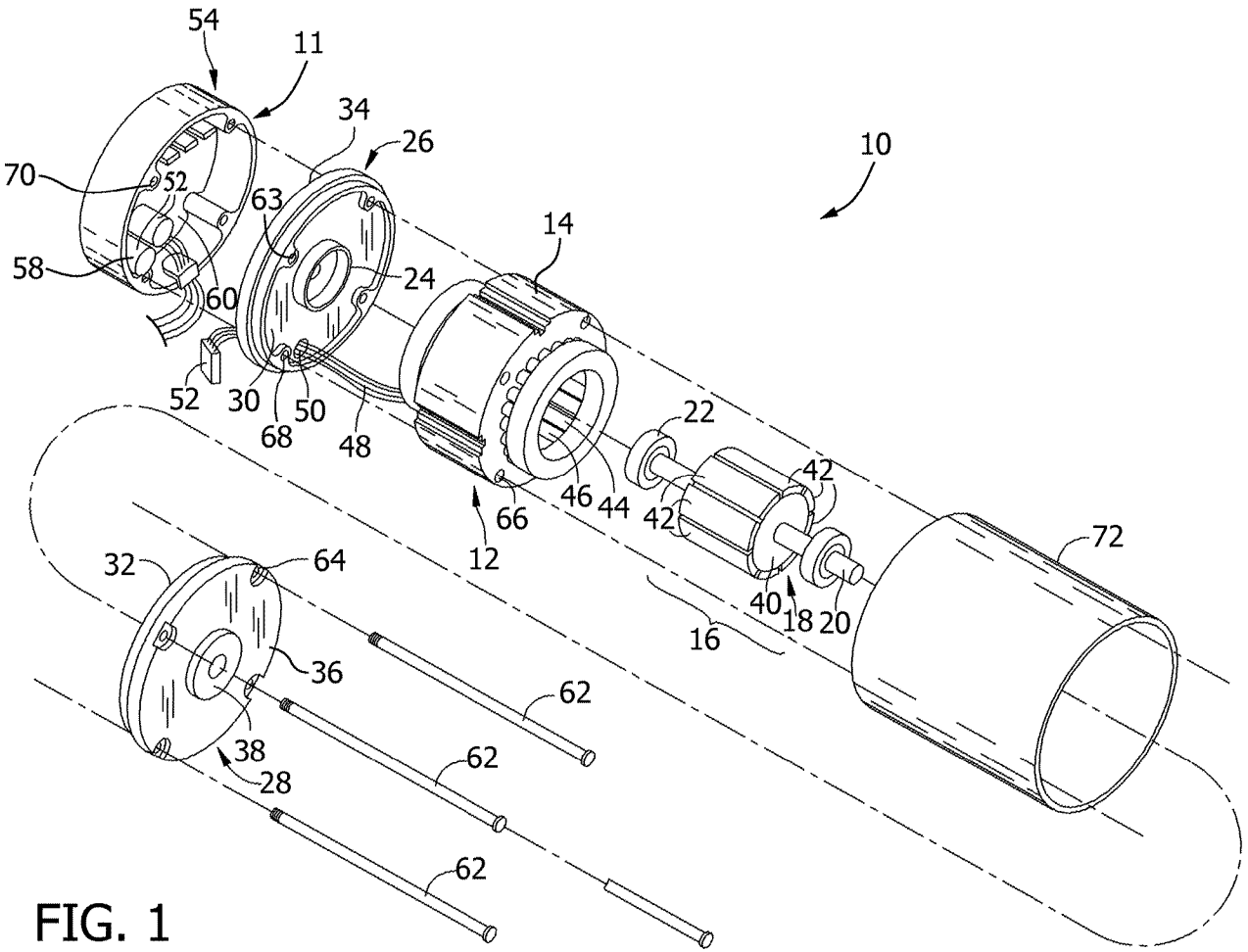
FIG. 1 is an exploded view of an exemplary electric motor.

FIG. 1 is an exploded view of an exemplary motor 10. Motor 10 includes control system 11, a stationary assembly 12 including a stator or core 14, and a rotatable assembly 16 including a permanent magnet rotor 18 and a shaft 20. In the exemplary embodiment, motor 10 is used in a heating, ventilating and air conditioning system (not shown). In the exemplary embodiment, control system 11 is integrated with motor 10. Alternatively, motor 10 may be external to and/or separate from control system 11.

Rotor 18 is mounted on and keyed to shaft 20 journaled for rotation in conventional bearings 22. Bearings 22 are mounted in bearing supports 24 integral with a first end member 26 and a second end member 28. End members 26 and 28 have inner facing sides 30 and 32 between which stationary assembly 12 and rotatable assembly 16 are located. Each end member 26 and 28 has an outer side 34 and 36 opposite its inner side 30 and 32. Additionally, second end member 28 has an aperture 38 for shaft 20 to extend through outer side 34.

Rotor 18 comprises a ferromagnetic core 40 and is rotatable within stator 14. Segments 42 of permanent magnet material, each providing a relatively constant flux field, are secured, for example, by adhesive bonding to rotor core 40. Segments 42 are magnetized to be polarized radially in relation to rotor core 40 with adjacent segments 42 being alternately polarized as indicated. While magnets on rotor 18 are illustrated for purposes of disclosure, it is contemplated that other rotors having different constructions and other magnets different in both number, construction, and flux fields may be utilized with such other rotors within the scope of the invention.

Stationary assembly 12 comprises a plurality of winding stages 44 adapted to be electrically energized to generate an electromagnetic field. Stages 44 are coils of wire wound around teeth 46 of laminated stator core 14. Winding terminal leads 48 are brought out through an aperture 50 in first end member 26 terminating in a connector 52. While stationary assembly 12 is illustrated for purposes of disclosure, it is contemplated that other stationary assemblies of various other constructions having different shapes and with different number of teeth may be utilized within the scope of the invention.

Motor 10 further includes an enclosure 54 which mounts on the rear portion of motor 10. Control system 11 includes a plurality of electronic components 58 and a connector (not shown in FIG. 1) mounted on a component board 60, such as a printed circuit board. Control system 11 is connected to winding stages 44 by interconnecting connector 52. Control system 11 applies a voltage to one or more of winding stages 44 at a time for commutating winding stages 44 in a preselected sequence to rotate rotatable assembly 16 about an axis of rotation.

Connecting elements 62 include a plurality of bolts that pass through bolt holes 64 in second end member 28, bolt holes 66 in core 14, bolt holes 68 in first end member 26, and bolt holes 70 in enclosure 44. Connecting elements 62 are adapted to urge second end member 28 and enclosure 44 toward each other thereby supporting first end member 26, stationary assembly 12, and rotatable assembly 16 therebetween. Additionally, a housing 72 is positioned between first end member 26 and second end member 28 to facilitate enclosing and protecting stationary assembly 12 and rotatable assembly 16.

Motor 10 may include any even number of rotor poles and the number of stator poles are a multiple of the number of rotor poles. For example, the number of stator poles may be based on the number of phases. In one embodiment (not shown), a three-phase motor 10 includes six rotor pole pairs and stator poles.

Figure 2:
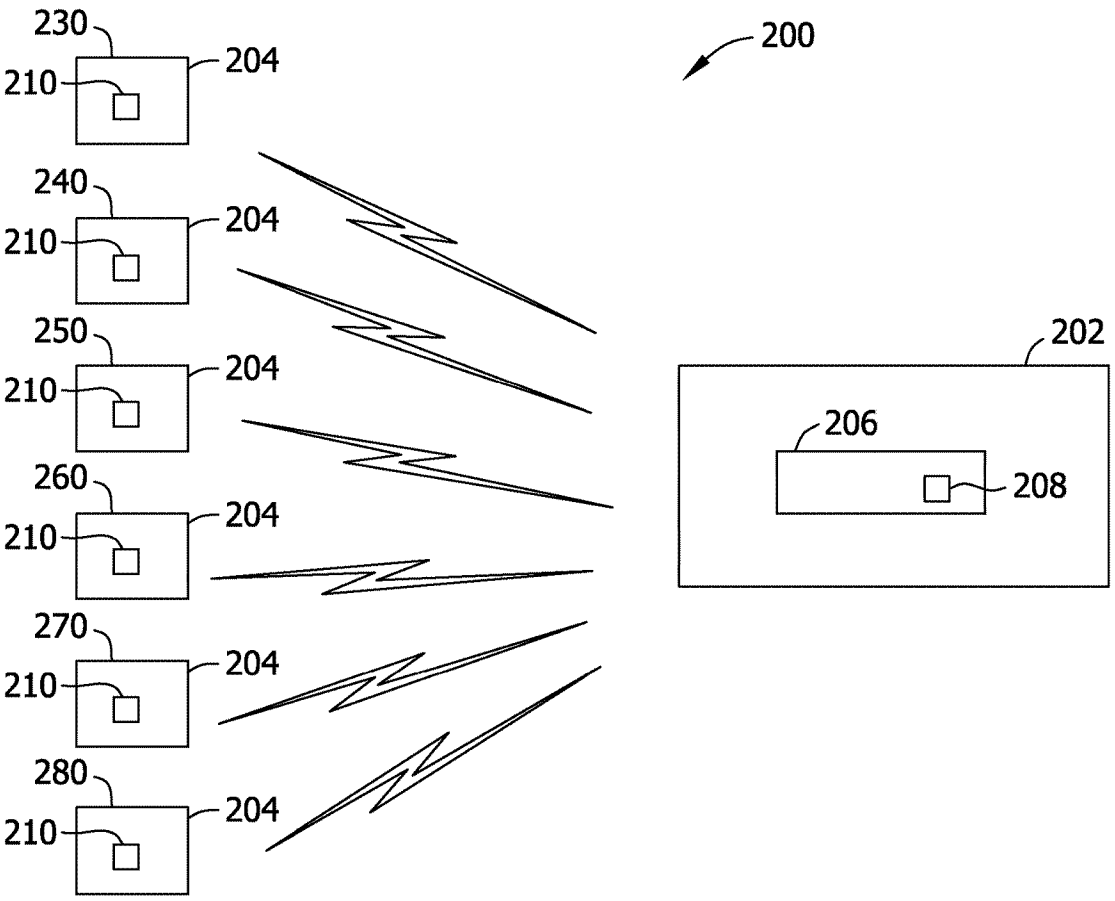
FIG. 2 is a schematic diagram of an exemplary motor communication system that may be used with electric motor shown in FIG. 1.

FIG. 2 is a schematic diagram of an exemplary electric motor communication system 200. Electric motor communication system 200 includes an electric motor 202, such as electric motor 10 (shown in FIG. 1), and a plurality of external devices 204. As described in detail herein, electric motor 202 is communicatively coupled to one or more external devices 204 such that electric motor 202 is capable of bi-directional wireless communication with one or more external devices 204.

In the exemplary embodiment, electric motor 202 is utilized as a fan and/or blower motor in a fluid (e.g., water, air, etc.) moving system. For example, electric motor 202 may be utilized in a clean room filtering system, a fan filter unit, a variable air volume system, a refrigeration system, a furnace system, an air conditioning system, and/or a residential or commercial heating, ventilation, and air conditioning (HVAC) system. Alternatively, electric motor 202 may be implemented in any application that enables electric motor communication system 200 to function as described herein. Electric motor 202 may also be used to drive mechanical components other than a fan and/or blower, including mixers, gears, conveyors, and/or treadmills.

Electric motor 202 includes a computing device 206 that controls operation of electric motor 202 and facilitates wireless communication between electric motor 202 and external devices 204, as described in detail below. In the exemplary embodiment, computing device 206 includes a wireless communication unit 208 that transmits and receives wireless signals to and from one or more external device 204. Similarly, external devices 204 each include a wireless communication unit 210 for transmitting and receiving wireless signals to and from electric motor 202. In the exemplary embodiment, wireless communication units 208 and 210 are wireless antennae. Alternatively, wireless communication units 208 and/or 210 are any device that enables electric motor communication system 200 to function as described herein.

In the exemplary embodiment, electric motor 202 communicates with external devices 204 over an IEEE 802.11 (Wi-Fi) network. Alternatively, electric motor 202 communicates with external devices 204 using any communication medium and/or network that enables system 200 to function as described herein. Exemplary networks include a mesh network, a cellular network, a general packet radio service (GPRS) network, an Enhanced Data Rates for Global Evolution (EDGE) network, a WiMAX network, a P1901 network, and/or a ZIGBEE® network (e.g., ZigBee Smart Energy 1.0, ZigBee Smart Energy 2.0). ZIGBEE® is a registered trademark of ZigBee Alliance, Inc., of San Ramon, Calif.

A plurality of different types of external devices 204 may communicate wirelessly with electric motor 202. In the exemplary embodiment, external devices 204 include a system controller 230, a diagnostic tool 240, a thermostat 250, a sensor 260, a database server 270, and a radio frequency identification (RFID) reader 280, each described in detail below. Alternatively, external devices 204 may include any device capable of wireless communication with electric motor 202.

Figure 3:
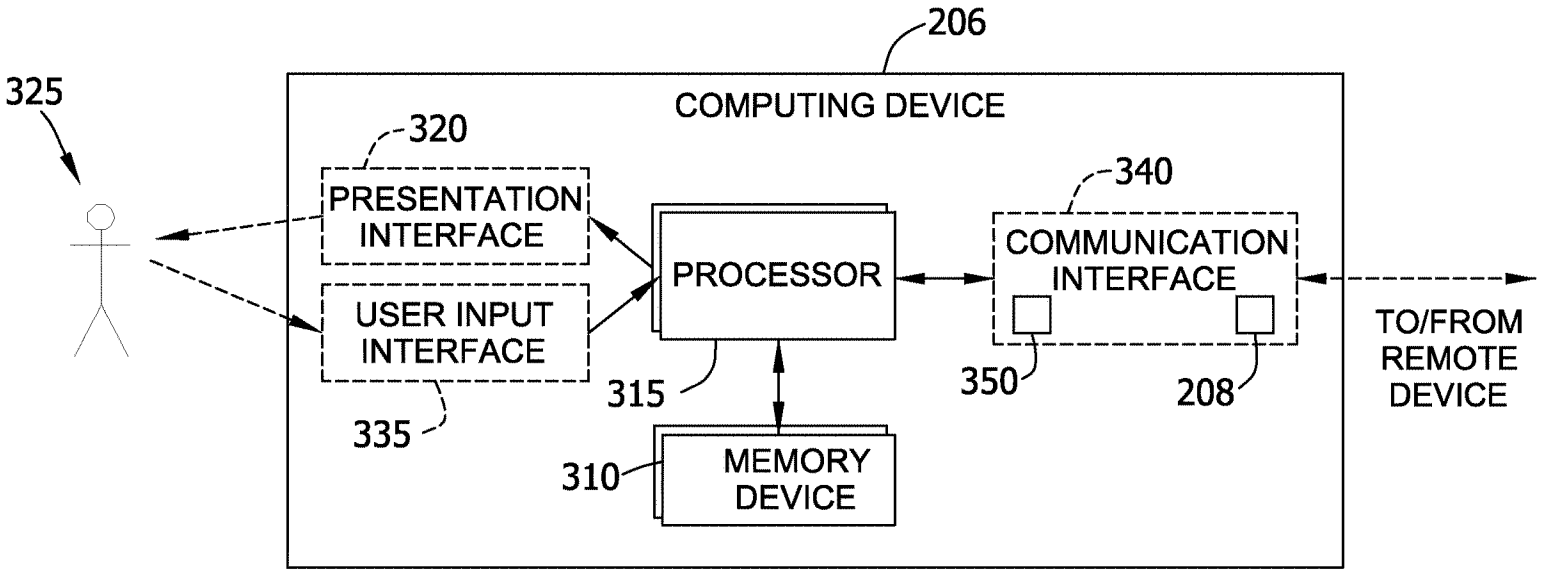
FIG. 3 is a block diagram of an exemplary computing device that may be used with the electric motor shown in FIG. 2.

FIG. 3 is a block diagram of computing device 206 that may be used with electric motor communication system 200 (shown in FIG. 2). Computing device 206 includes at least one memory device 310 and a processor 315 that is coupled to memory device 310 for executing instructions. In some embodiments, executable instructions are stored in memory device 310. In the exemplary embodiment, computing device 206 performs one or more operations described herein by programming processor 315. For example, processor 315 may be programmed by encoding an operation as one or more executable instructions and by providing the executable instructions in memory device 310.

Processor 315 may include one or more processing units (e.g., in a multi-core configuration). Further, processor 315 may be implemented using one or more heterogeneous processor systems in which a main processor is present with secondary processors on a single chip. As another illustrative example, processor 315 may be a symmetric multiprocessor system containing multiple processors of the same type. Further, processor 315 may be implemented using any suitable programmable circuit including one or more systems and microcontrollers, microprocessors, reduced instruction set circuits (RISC), application specific integrated circuits (ASIC), programmable logic circuits, field programmable gate arrays (FPGA), and any other circuit capable of executing the functions described herein. In the exemplary embodiment, processor 315 controls operation of electric motor 202 (shown in FIG. 2).

In the exemplary embodiment, memory device 310 is one or more devices that enable information such as executable instructions and/or other data to be stored and retrieved. Memory device 310 may include one or more computer readable media, such as, without limitation, dynamic random access memory (DRAM), static random access memory (SRAM), a solid state disk, and/or a hard disk. Memory device 310 may be configured to store, without limitation, application source code, application object code, source code portions of interest, object code portions of interest, configuration data, execution events and/or any other type of data. In the exemplary embodiment, memory device 310 includes firmware and/or initial configuration data for electric motor 202.

In the exemplary embodiment, computing device 206 includes a presentation interface 320 that is coupled to processor 315. Presentation interface 320 presents information, such as application source code and/or execution events, to a user 325. For example, presentation interface 320 may include a display adapter (not shown) that may be coupled to a display device, such as a cathode ray tube (CRT), a liquid crystal display (LCD), an organic LED (OLED) display, and/or an "electronic ink" display. In some embodiments, presentation interface 320 includes one or more display devices.

In the exemplary embodiment, computing device 206 includes a user input interface 335 that is coupled to processor 315 and receives input from user 325. User input interface 335 may include, for example, a keyboard, a pointing device, a mouse, a stylus, a touch sensitive panel (e.g., a touch pad or a touch screen), a gyroscope, an accelerometer, a position detector, and/or an audio user input interface. A single component, such as a touch screen, may function as both a display device of presentation interface 320 and user input interface 335.

Computing device 206 includes a communication interface 340 coupled to processor 315. Communication interface 340 communicates with one or more remote devices, such as external devices 204 (shown in FIG. 2). In the exemplary embodiment, communication interface 340 includes wireless communication unit 208 and a signal converter 350 that converts wireless signals received by wireless communication unit 208. For example, in one embodiment, signal converter 350 converts a wireless signal received by wireless communication unit 208 into a control signal that processor 315 utilizes to control operation of electric motor 202.

Computing device 206 may include more or less components than those specifically shown in FIG. 3. For example, in at least some embodiments, computing device 206 does not include presentation interface 320 and user input interface 335.

Figure 4:
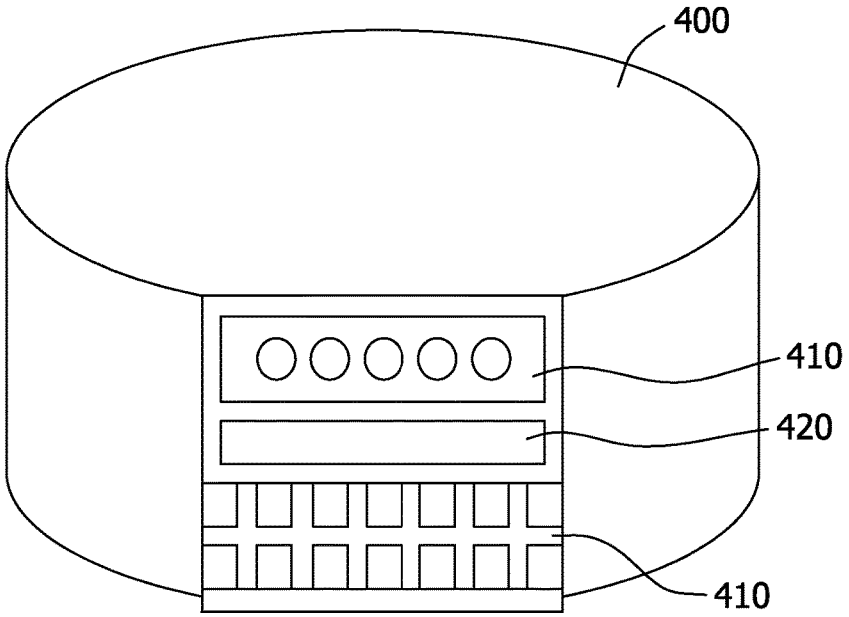
FIG. 4 is a schematic diagram of an exemplary motor control connector that may be used with the electric motor shown in FIG. 2.

FIG. 4 is a schematic diagram of an exemplary motor control connector 400 that may be used with electric motor 202 (shown in FIG. 2). Motor control connector 400 includes processor 315 (shown in FIG. 3) in the exemplary embodiment. Motor control connector 400 includes connectors 410 that couple motor control connector 400 to one or more components of electric motor 202. For example, motor control connector 400 may connect to component board 60 (shown in FIG. 1).

In the exemplary embodiment, motor control connector 400 includes a radio frequency identification (RFID) chip 420. Alternatively, RFID chip 420 may be located on other components of electric motor 202. RFID chip 420 interfaces with one or more of external devices 204, as described in detail below. Further, in some embodiments, motor control connector 400 may additionally or alternatively include a chip to facilitate near field communications (NFC) between electric motor 202 and one or more external devices 204.

Referring back to FIG. 2, as described above, external devices 204 include a system controller 230, a diagnostic tool 240, a thermostat 250, a sensor 260, a database server 270, and an RFID reader 280 in the exemplary embodiment.

System controller 230 uses wireless communication to control operation of electric motor 202. In the exemplary embodiment, system controller 230 is a system controller for an HVAC system. Alternatively, system controller 230 may be a controller for a furnace system, an air-conditioning system, a ventilation system, a refrigeration system, and/or any other system that enables system controller 230 to function as described herein.

To control operation of electric motor 202, system controller 230 transmits one or more wireless signals to wireless communication unit 208. Using computing device 206, the wireless signals are converted to control signals that are implemented using motor control connector 400 (shown in FIG. 4). The control signals control one or more operating parameters of electric motor 202. Operating parameters may include, but are not limited to, a speed, a direction of rotation, and a torque level of electric motor 202. In one embodiment, system controller 230 includes a user input interface, similar to user input interface 335 (shown in FIG. 3), that enables a user to input control commands to be transmitted to electric motor 202 as wireless signals.

In the exemplary embodiment, system controller 230 wirelessly transmits initial configuration data to electric motor 202. The initial configuration data includes a set of predetermined operating parameters. Specifically, unless electric motor 202 receives control signals altering its operation (for example, from system controller 230), electric motor 202 operates according to the operating parameters specified in the initial configuration data. In the exemplary embodiment, the initial configuration data is received by communication interface 340 and stored in memory device 310 (both shown in FIG. 3). Processor 315 reads the initial configuration data from memory device 310 and controls operation of electric motor 202 accordingly. As system controller 230 does not need to be physically coupled (e.g., using wires, cables, etc.) to electric motor 202, system controller 230 can wirelessly supply initial configuration data to a plurality of electric motors 202 in a relatively short period of time. For example, in some embodiments, initial configuration data is supplied to a plurality of electric motors 202 simultaneously.

Diagnostic tool 240 uses wireless communication to collect diagnostic information from electric motor 202. Diagnostic information may include, for example, input power consumption, operating speed, operating torque level, operating temperature, frequency of thermostat cycling, total number of failures of electric motor 202 (fault event count), total length of time that electric motor 202 has received power (total powered time), total length of time that electric motor 202 has operated at or above a preset threshold (total run time), total length of time that electric motor 202 has operated at a speed that exceeds a preset rate of speed (total time in a cutback region), total time that electric motor 202 has operated with a baseplate temperature over a preset thermal limit (total time over thermal limit), and/or total number of times that electric motor 202 has been started (total run cycles).

In the exemplary embodiment, the diagnostic information is stored in memory device 310 (shown in FIG. 3). In one embodiment, wireless communication unit 208 of electric motor 202 periodically transmits diagnostic information stored to diagnostic tool 240 and/or other external devices 204. In another embodiment, wireless communication unit 208 transmits diagnostic information in response to a request for diagnostic information sent by diagnostic tool 240 and/or other external devices 204.

Diagnostic tool 240 may include a presentation interface (not shown), similar to presentation interface 320 (shown in FIG. 3), that displays the diagnostic information to a user. The presentation interface may also display alerts and/or warnings to the user. For example, the presentation interface may display a warning when an operating temperature of electric motor 202 is above a predetermined threshold or when a voltage abnormality is detected. In another example, if diagnostic information indicates unusual operation of electric motor 202 indicative of clogged filters, the presentation interface may display an alert that filters need to be cleaned and/or replaced in electric motor 202. In response to observing the alert and/or warning, the user can take appropriate action.

Diagnostic tool 240 may further include a user input interface (not shown), similar to user input interface 335 (shown in FIG. 3), that enables the user to request diagnostic information from electric motor 202 and/or control the information displayed on diagnostic tool 240. In the exemplary embodiment, diagnostic tool 240 is a hand-held, portable device. Accordingly, a user can wirelessly gather diagnostic information for a plurality of motors 202 in a relatively short period of time. For example, in some embodiments, diagnostic information is gathered from a plurality of electric motors 202 simultaneously using a single diagnostic tool 240.

Thermostat 250 uses wireless communication to interface with electric motor 202. In the exemplary embodiment, thermostat 250 includes a plurality of user-selectable settings, or modes, related to operation of electric motor 202. For example, when electric motor 202 is part of an HVAC system, thermostat 250 may include low heat, high heat, cooling, dehumidify, and/or continuous fan modes. A user input interface (not shown) on thermostat 250, similar to user input interface 335 (shown in FIG. 3), enables the user to select a desired mode. When the user selects a mode, thermostat 250 wirelessly transmits signals to electric motor 202 that cause electric motor 202 to operate in accordance with the selected mode.

In the exemplary embodiment, where electric motor 202 is implemented in an HVAC system, thermostat 250 detects an ambient air temperature. The detected air temperature may be displayed using a presentation interface (not shown), similar to presentation interface 320 (shown in FIG. 3). The presentation interface may also display the currently selected mode. In one embodiment, the detected air temperature is wirelessly transmitted to electric motor 202, and the operation of electric motor 202 is controlled based on the detected air temperature. For example, if electric motor 202 is blowing cool air, when electric motor 202 receives a detected air temperature below a preset temperature, processor 315 (shown in FIG. 3) may instruct electric motor 202 to cease rotation (i.e., stop blowing cool air).

Sensor 260 uses wireless communication to interface with electric motor 202. In the exemplary embodiment, sensor 260 includes a $CO/NO_x$ sensor, a $CO_2$ sensor, a vibration sensor, a temperature sensor, a diagnostic sensor, an indoor air quality (IAQ) sensor, and/or a sensor that measures one or more operating parameters of electric motor 202. Alternatively, sensor 260 may include any type of sensor that enables electric motor communication system 200 to function as described herein.

In the exemplary embodiment, one or more measurements taken by sensor 260 are wirelessly transmitted to electric motor 202, and the operation of electric motor 202 is controlled based on the one or more measurements. For example, if sensor 260 measures an operating temperature of electric motor 202 above a predetermined threshold, processor 315 may adjust one or more operating parameters (e.g., reduce the operating speed) of electric motor 202 in response.

Database server 270 uses wireless communication to receive and store data related to operation of electric motor 202. In the exemplary embodiment, database server 270 includes a memory device, similar to memory device 310 (shown in FIG. 3). The data stored on database server 270 may include, for example, diagnostic information for electric motor 202, configuration data for electric motor 202, and/or measurements from sensor 260. Data may be transmitted to database server 270 from electric motor 202 and/or sensor 260 periodically, continuously, and/or in response to user input.

RFID reader 280 uses wireless communication to transmit and receive data to and from electric motor 202. In the exemplary embodiment, RFID reader 280 communicates directly with RFID chip 420 (shown in FIG. 4). Specifically, RFID reader interrogates RFID chip 420 by transmitting a radio signal to RFID chip 420 and receiving a response radio signal from RFID chip 420. The response radio signal may include information on electric motor 202 including, for example, configuration data for electric motor 202, diagnostic information for electric motor 202, a commission date of electric motor 202, a batch number of electric motor 202, a model of electric motor 202, and/or a serial number of electric motor 202.

RFID chip 420 may be a passive RFID chip or an active RFID chip. If RFID chip 420 is passive, the interrogation signal from RFID reader 280 provides the power necessary for RFID chip 420 to generate a response radio signal. Accordingly, a passive RFID chip 420 can generate a response radio signal even when electric motor 202 is powered down.

If RFID chip 420 is active, RFID chip 420 generally requires a power source to generate a response radio signal. However, as an active RFID chip 420 has its own power source, RFID chip 420 can broadcast the response radio signal periodically, without first receiving a signal from RFID reader 280.

The response radio signal transmitted from RFID chip 420 is received by RFID reader 280. In the exemplary embodiment, RFID reader 280 includes suitable software for extracting the identification information from the response radio signal. Alternatively, RFID reader 280 transmits the received radio response signal to a computer system running software for extracting the information from the response radio signal.

In the exemplary embodiment, RFID chip 420 includes a memory, such as memory device 310 (shown in FIG. 3) that can be written to and read by RFID reader 208. Configuration data for electric motor 202, diagnostic information for electric motor 202, a commission date of electric motor 202, a batch number of electric motor 202, a model of electric motor 202, and/or a serial number of electric motor 202 may be stored on the memory. In one embodiment, RFID reader 208 transmits configuration data to RFID chip 420. The received configuration data is stored in the memory and used by processor 315 (shown in FIG. 3) to operate electric motor 202.

In the exemplary embodiment RFID reader 280 is a hand-held, portable device. Accordingly, RFID reader 280 can be used to wirelessly read data from and/or write data to a plurality of electric motors 202 that each include RFID chip 420 in a relatively short period of time.

Although system controller 230, diagnostic tool 240, thermostat 250, sensor 260, database server 270, and RFID reader 280 are shown as separate devices, multiple external devices 204 may be implemented in the same physical device. Further, one or more of external devices 204 may be implemented in a smartphone, laptop computer, or tablet computing device.

Figure 5:
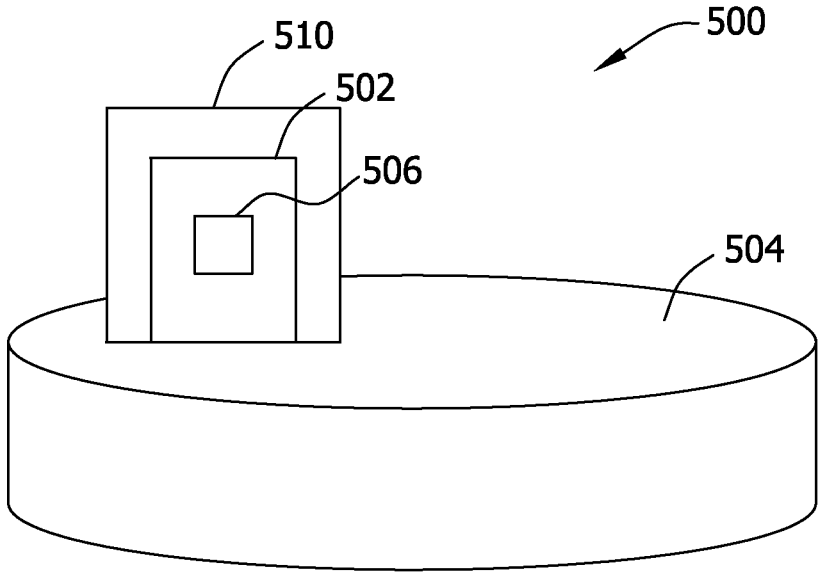
FIG. 5 is a schematic diagram of an exemplary daughterboard assembly that may be used with the electric motor shown in FIG. 2.

FIG. 5 is a schematic diagram of an exemplary daughterboard assembly 500 that may be used with electric motor 202 (shown in FIG. 2). Assembly 500 includes a daughterboard 502 coupled to a motor controller 504. For example, daughterboard 502 may be coupled to control system 11 via component board 60 (both shown in FIG. 2).

Daughterboard 502 may be used as an alternative to or in addition to motor control connector 400 (shown in FIG. 4) to facilitate wireless functionality of electric motor 202. Accordingly, similar to motor control connector 400, daughterboard 502 includes a processor 315 (shown in FIG. 3) and connector (not shown) that couples daughterboard to motor controller 504.

Daughterboard 502 includes a wireless communication module 506 that enables wireless communications between processor 315 and external devices 204. For example, wireless communication module 506 may include an RFID chip, a Wi-Fi device, a NFC device, and/or any other device that facilitates sending and receiving signals wirelessly.

In the exemplary embodiment, a holder 510 substantially surrounds daughterboard 502 and maintains the physical connection between daughterboard 502 and motor controller 504. Specifically, holder 510 secures a position of daughterboard 502 relative to motor controller 504. In the exemplary embodiment, holder 510 is made of a material substantially transparent to wireless signals and/or frequencies (e.g., clear plastic). Accordingly, for wireless transmissions to and from daughterboard 502, holder 510 functions as a window and does not impair such transmissions.

In some embodiments, daughterboard assembly 500 does not include holder 510, and daughterboard 502 is positioned such that wireless signals may be transmitted to and from daughterboard 502. That is, daughterboard 502 may be positioned in any orientation that enables wireless communication with external devices 204 outside of electric motor 202. Notably, radio frequency signals can propagate through plastic or other non-metallic materials. Accordingly, daughterboard 502 need not have a clear line of sight to an area outside of electric motor 202 to facilitate wireless communications.

Using daughterboard 502, existing motors can be upgraded to include wireless functionality, as described herein. That is, daughterboard 502 may be connected to a motor controller in an electric motor that did not previously have wireless functionality. By connecting daughterboard 502, wireless functionality may be added to the electric motor relatively quickly and easily.

An electric motor communication system for use with a fluid moving system is disclosed. The electric motor communication system includes an electric motor including a wireless communication device configured to transmit and receive wireless signals, and a processing device coupled to the wireless communication device and configured to control the electric motor based at least in part on wireless signals received at the wireless communication device. The electric motor communication system further includes at least one external device configured to communicate wirelessly with the electric motor.

In one embodiment, the external device is a system controller configured to transmit wireless signals that include at least one of configuration data for the electric motor and control commands for the electric motor. The system controller may be, for example, a heating, ventilation, and air conditioning (HVAC) system controller.

In another embodiment the external device is a thermostat. The thermostat includes a plurality of user-selectable modes and is configured to transmit wireless signals to the electric motor. The wireless signals transmitted to the electric motor from the thermostat cause the electric motor to operate in accordance with a selected mode of the plurality of user-selectable modes.

In yet another embodiment, the external device is a sensor configured to wirelessly transmit sensor measurements to the electric motor. The sensor is at least one of a $CO/NO_x$ sensor, a $CO_2$ sensor, a vibration sensor, a temperature sensor, a diagnostic sensor, an indoor air quality (IAQ) sensor, and a sensor that measures at least one operating parameter of the electric motor.

In yet another embodiment, the at least one external device is a database server configured to wirelessly receive and store information from the electric motor.

In yet another embodiment, the wireless communication device includes a radio frequency identification (RFID) chip, and the external device is an RFID reader. The RFID reader is configured to update configuration data stored on the RFID chip by wirelessly transmitting updated configuration data to the RFID chip. The electric motor further includes a motor control connector, and the RFID chip is installed on the motor control connector.

An electric motor for use in a fluid-moving system is disclosed. The electric motor includes a wireless communication device configured to transmit and receive wireless signals to and from at least one external device, and a processing device coupled to the wireless communication device and configured to control the electric motor based at least in part on wireless signals received at the wireless communication device.

In one embodiment, the wireless communication device is configured to transmit and receive wireless signals to and from at least one of a system controller, a thermostat, a diagnostic tool, a database server, and a sensor.

In another embodiment, the wireless communication device is a radio frequency identification (RFID) chip configured to communicate wirelessly with an RFID reader. The RFID chip is coupled to a motor control connector of the electric motor.

In yet another embodiment, the electric motor further includes a signal converter configured to convert signals received by the wireless communication device into control signals readable by the processing device.

A method of operating an electric motor in a fluid-moving system is disclosed. The method includes communicatively coupling the electric motor to at least one external device, the electric motor including a wireless communication device and a processing device coupled to the wireless communication device, receiving, at the wireless communication device, wireless signals from the at least one external device, and controlling, using the processing device, the electric motor based at least in part on the received wireless signals.

In one embodiment, receiving wireless signals from the at least one external device includes receiving wireless signals from a system controller.

In another embodiment, receiving wireless signals from the at least external device includes receiving wireless signals from a thermostat that includes a plurality of user-selectable modes. The wireless signals specify a selected mode of the plurality of user-selectable modes.

In yet another embodiment, receiving wireless signals includes receiving wireless signals that include configuration data for the electric motor.

As compared to as least some known electric motor systems, the methods and systems described herein utilize wireless communications. Using wireless connections in place of physical connections facilitates reducing costs associated with manufacturing and operating electric motor systems. For example, wireless connections occupy less physical space and are generally more reliable than physical connections. Further, as compared to at least some known electric motor systems, the systems and methods described herein enable configuring, controlling, and/or gathering data from a plurality of electric motors in a relatively short time period, and in some embodiments, simultaneously.

The systems and methods described herein facilitate efficient and economical manufacture and operation of an electric motor system. Exemplary embodiments of methods and systems are described and/or illustrated herein in detail. The methods and systems are not limited to the specific embodiments described herein, but rather, components of each system, as well as steps of each method, may be utilized independently and separately from other components and steps described herein. Each component, and each method step, can also be used in combination with other components and/or method steps.

When introducing elements/components/etc. of the methods and systems described and/or illustrated herein, the articles "a", "an", "the", and "said" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electric motor communication system for use with a heating, ventilation and air conditioning (HVAC) system, said electric motor communication system comprising:

an electric motor assembly comprising:

an electric motor including a plurality of winding stages housed within a motor housing; and a motor controller coupled to the motor housing, said motor controller comprising:

an enclosure mounted to the motor housing;

a wireless communication device comprising a wireless antenna positioned within said enclosure, said wireless antenna configured to transmit wireless signals from said electric motor including performance data associated with operation of said electric motor and failure data associated with a failure of said electric motor to at least one external device in response to a request from the at least one external device, said wireless antenna configured to receive wireless signals for said electric motor, the received wireless signals including at least a control signal corresponding to updated operating parameters to be applied by said motor controller to operate said electric motor;

a processing device coupled to said wireless communication device and configured to control said electric motor based at least in part on the updated operating parameters received at said wireless communication device; and a daughterboard mounted on a printed circuit board (PCB) internally within said enclosure of said motor controller and configured to secure said wireless communication device and said processing device on said PCB within said motor controller and to communicatively couple said wireless communication device and said processing device; and the at least one external device configured to communicate wirelessly with said electric motor assembly to provide the control signal including the updated operating parameters and receive at least one of the performance data and failure data transmitted by said wireless communication device via said wireless antenna based upon the request.

2. An electric motor communication system in accordance with claim 1, wherein said at least one external device is a system controller configured to transmit wireless signals that include at least one of configuration data for said electric motor and control commands for said electric motor.

3. An electric motor communication system in accordance with claim 2, wherein said system controller is a HVAC system controller.

4. An electric motor communication system in accordance with claim 1, wherein said at least one external device is a diagnostic tool configured to wirelessly collect diagnostic information from said electric motor.

5. An electric motor communication system in accordance with claim 1, wherein said at least one external device is a thermostat including a plurality of user-selectable modes and configured to transmit wireless signals to said electric motor that cause said electric motor to operate in accordance with a selected mode of the plurality of user-selectable modes.

6. An electric motor communication system in accordance with claim 1, wherein said at least one external device is a sensor configured to wirelessly transmit sensor measurements to said electric motor.

7. An electric motor communication system in accordance with claim 6, wherein said sensor is at least one of a $CO/NO_X$ sensor, a $CO_2$ sensor, a vibration sensor, a temperature sensor, a diagnostic sensor, an indoor air quality (IAQ) sensor, and a sensor that measures at least one operating parameter of said electric motor.

8. An electric motor communication system in accordance with claim 1, wherein said at least one external device is a database server configured to wirelessly receive and store information from said electric motor.

9. An electric motor communication system in accordance with claim 1, wherein said wireless communication device comprises a radio frequency identification (RFID) chip, and wherein said at least one external device is an RFID reader.

10. An electric motor communication system in accordance with claim 9, wherein said RFID reader is configured to update configuration data stored on said RFID chip by wirelessly transmitting updated configuration data to said RFID chip.

11. An electric motor communication system in accordance with claim 1, wherein said motor controller further comprises:

a motor control connector defined through an outer shell of said motor controller; and at least one of an RFID chip and an RFID antenna coupled to said motor control connector.

12. An electric motor for use in a heating, ventilation and air conditioning (HVAC) system, said electric motor comprising:

a motor housing configured to house a plurality of winding stages; and a motor controller coupled to said motor housing, said motor controller comprising:

an enclosure mounted to the motor housing;

a wireless communication device comprising a wireless antenna positioned within said enclosure, said wireless antenna configured to transmit wireless signals from said electric motor including performance data associated with operation of said electric motor and failure data associated with a failure of said electric motor to at least one external device in response to a request from the at least one external device, said wireless antenna configured to receive wireless signals for said electric motor from said at least one external device, the received wireless signals including at least a control signal corresponding to updated operating parameters to be applied by said motor controller to operate said electric motor;

a processing device coupled to said wireless communication device and configured to control said electric motor based at least in part on the updated operating parameters received at said wireless communication device; and a daughterboard mounted on a printed circuit board (PCB) internally within said enclosure of said motor controller and configured to secure said wireless communication device and said processing device on said PCB within said motor controller and to communicatively couple said wireless communication device and said processing device.

13. An electric motor in accordance with claim 12, wherein the at least one external device comprises at least one of a system controller, a thermostat, a diagnostic tool, a database server, and a sensor.

14. An electric motor in accordance with claim 12, wherein said wireless communication device is a radio frequency identification (RFID) chip configured to communicate wirelessly with an RFID reader.

15. An electric motor in accordance with claim 14 wherein said daughterboard is coupled to a controller of said electric motor.

16. An electric motor in accordance with claim 12, further comprising a substantially transparent holder, wherein said substantially transparent holder facilitates maintaining a connection between said daughterboard and said processing device.

17. A method of operating an electric motor in a heating, ventilation and air conditioning (HVAC) system, said method comprising:

communicatively coupling the electric motor to at least one external device, the electric motor including a motor housing and a motor controller coupled to the motor housing, the motor controller including an enclosure mounted to the motor housing, a wireless communication device including a wireless antenna positioned within the enclosure, a processing device, and a daughterboard, the daughterboard mounted on a printed circuit board (PCB) internally within the enclosure of the motor controller and configured to secure the wireless communication device and the processing device on the PCB;

transmitting, by the wireless communication device via the wireless antenna, wireless signals from the electric motor to the at least one external device, the transmitted wireless signals including performance data associated with operation of the electric motor and failure data associated with a failure of the electric motor in response to a request from the at least one external device;

receiving, at the wireless communication device via the wireless antenna, wireless signals from the at least one external device, the wireless communication device communicatively coupled to the processing device by the daughterboard, the received wireless signals, from the at least one external device, including at least a control signal corresponding to updated operating parameters to be applied by the motor controller to operate the electric motor; and controlling, using the processing device, the electric motor based at least in part on the received updated operating parameters.

18. A method in accordance with claim 17, wherein receiving wireless signals from the at least one external device comprises receiving wireless signals from a system controller.

19. A method in accordance with claim 17, wherein receiving wireless signals from the at least external device comprises receiving wireless signals from a thermostat that includes a plurality of user-selectable modes and wherein the wireless signals specify a selected mode of the plurality of user-selectable modes.

20. A method in accordance with claim 17, wherein receiving wireless signals comprises receiving wireless signals that include configuration data for the electric motor.

* * * * *